US009843113B1

(12) United States Patent
Campbell

(10) Patent No.: US 9,843,113 B1
(45) Date of Patent: Dec. 12, 2017

(54) CRIMPLESS ELECTRICAL CONNECTORS

(71) Applicant: ITT Manufacturing Enterprises LLC, Wilmington, DE (US)

(72) Inventor: Charles Campbell, Santa Rosa, CA (US)

(73) Assignee: ITT MANUFACTURING ENTERPRISES LLC, Wilmington, DE (US)

( * ) Notice: Subject to any disclaimer, the term of this patent is extended or adjusted under 35 U.S.C. 154(b) by 0 days.

(21) Appl. No.: 15/481,189

(22) Filed: Apr. 6, 2017

(51) Int. Cl.
*H01R 4/30* (2006.01)
*H01R 4/32* (2006.01)
*H01R 13/05* (2006.01)

(52) U.S. Cl.
CPC ..... *H01R 4/305* (2013.01); *H01R 4/302* (2013.01); *H01R 4/32* (2013.01); *H01R 13/052* (2013.01)

(58) Field of Classification Search
CPC ..... H01R 4/32; H01R 4/302; H01R 4/305; H01R 13/15; H01R 13/052; H01R 13/187
USPC ..... 439/778, 779, 780, 851, 852
See application file for complete search history.

(56) References Cited

U.S. PATENT DOCUMENTS 1,328,612 A * 1/1920 Becker ..... H01R 4/5025 403/308
1,769,101 A * 7/1930 Becker ..... H01R 4/5025 403/308
2,105,182 A * 1/1938 Church ..... H01R 4/5025 403/291
2,161,694 A * 6/1939 Becker ..... H01R 4/52 403/304
2,209,620 A * 7/1940 Berndt ..... H01R 4/52 174/74 R
3,641,479 A 2/1972 O'Brien et al.
3,652,777 A 3/1972 Elliott
3,729,699 A 4/1973 Briggs et al.
4,080,025 A 3/1978 Garnier et al.
4,105,279 A 8/1978 Glotin et al.
4,142,770 A 3/1979 Butler, Jr. et al.
4,174,875 A 11/1979 Wilson et al.
4,390,229 A 6/1983 Chevalier
4,488,765 A 12/1984 Erbe
4,500,151 A 2/1985 Ayers
4,500,156 A 2/1985 Nguyen
4,515,426 A 5/1985 Bager
(Continued)

FOREIGN PATENT DOCUMENTS

CN 101976782 2/2011
EP 0 637 675 2/1995
(Continued)

*Primary Examiner* — Tulsidas C Patel
*Assistant Examiner* — Travis Chambers
(74) *Attorney, Agent, or Firm* — Knobbe, Martens, Olson & Bear LLP

(57) ABSTRACT

Various crimpless electrical connector assemblies are disclosed. The crimpless connector can include a crimpless contact configured to join two electrical conductors. A portion of the crimpless contact can be received in an outer housing that comprises a tapered lumen. The crimpless contact can be coupled to an activation unit, such as with a threaded connection. Rotation of the activation unit can cause the crimpless contact to translate within the outer housing and the tines to be compressed against the first conductor, thereby physically securing the first conductor in the crimpless connector.

24 Claims, 11 Drawing Sheets

(56) References Cited

U.S. PATENT DOCUMENTS 4,561,679 A 12/1985 Choate
4,589,717 A 5/1986 Pottier et al.
4,752,252 A 6/1988 Cherry et al.
4,767,349 A 8/1988 Pottier et al.
4,780,574 A 10/1988 Neuroth
4,797,117 A 1/1989 Ayers
4,859,196 A 8/1989 Durando et al.
4,880,390 A 11/1989 Brackmann, Jr. et al.
4,948,377 A 8/1990 Cairns
5,059,139 A * 10/1991 Spinner ..... H01R 9/0521 439/578
5,334,032 A 8/1994 Myers et al.
5,435,745 A * 7/1995 Booth ..... H01R 9/0521 439/583
5,573,423 A 11/1996 Lin et al.
5,645,442 A 7/1997 Cairns
5,683,273 A 11/1997 Garver et al.
5,760,334 A 6/1998 Ziemek
5,863,220 A 1/1999 Holliday
5,868,554 A 2/1999 Giacomino et al.
5,899,765 A 5/1999 Niekrasz et al.
5,907,128 A 5/1999 Lanan et al.
5,975,939 A 11/1999 Market
6,027,373 A 2/2000 Gray et al.
6,168,455 B1 * 1/2001 Hussaini ..... H01R 9/0503 439/394
6,200,152 B1 3/2001 Hopper
6,261,126 B1 7/2001 Stirling
6,326,550 B1 12/2001 Dyer et al.
6,341,979 B1 1/2002 Yamamoto
6,559,383 B1 5/2003 Martin
6,780,037 B1 8/2004 Parmeter et al.
6,796,821 B2 9/2004 Cairns et al.
6,832,924 B2 12/2004 Maletzki et al.
6,848,939 B2 2/2005 Stirling
6,916,193 B2 7/2005 Varreng et al.
6,932,636 B2 8/2005 Abbey et al.
7,112,080 B2 9/2006 Nicholson
7,160,156 B2 1/2007 Holliday
7,367,848 B2 5/2008 John
7,425,153 B1 9/2008 Miller, Jr.
7,455,541 B2 11/2008 Jackson et al.
7,467,979 B2 12/2008 Colescott et al.
7,473,129 B2 1/2009 Jackson et al.
7,528,513 B2 5/2009 Oh
7,533,461 B2 5/2009 Griffiths
7,695,301 B2 4/2010 Mudge, III et al.
7,737,361 B2 6/2010 Huspeni et al.
7,752,918 B2 7/2010 Davis
7,767,908 B2 8/2010 Sylvan
7,806,708 B2 10/2010 Erstad
7,828,573 B2 11/2010 Butaud
7,901,240 B2 3/2011 Jackson et al.
7,955,105 B2 6/2011 Maeland
7,959,454 B2 6/2011 Ramasubramanian et al.
8,025,506 B2 9/2011 Cairns
8,083,544 B2 * 12/2011 Chee ..... H01R 24/542 439/578
8,172,612 B2 5/2012 Bence et al.
8,288,667 B2 * 10/2012 Chiou ..... H02G 3/0658 174/652
8,702,456 B1 * 4/2014 Wang ..... H01R 13/111 439/578
8,747,151 B2 6/2014 Sutter
8,816,196 B2 8/2014 Williams et al.
9,455,526 B2 9/2016 Morby et al.
2002/0046865 A1 4/2002 Bertini et al.
2003/0148638 A1 8/2003 McHugh et al.
2003/0172743 A1 9/2003 Ao et al.
2004/0118590 A1 6/2004 Head
2004/0211586 A1 10/2004 Sinha et al.
2004/0262025 A1 12/2004 Brandt et al.
2005/0056456 A1 3/2005 Ladie et al.
2005/0189130 A1 9/2005 Bertini et al.
2007/0010119 A1 1/2007 Hall et al.
2007/0015406 A1 1/2007 Chawgo
2007/0040459 A1 2/2007 Oh
2007/0155232 A1 7/2007 Burris et al.
2007/0169954 A1 7/2007 Bertini et al.
2009/0065237 A1 3/2009 Evoniuk et al.
2009/0233482 A1 9/2009 Chawgo et al.
2011/0130024 A1 6/2011 Cairns
2011/0306225 A1 12/2011 Chaize
2012/0097444 A1 4/2012 Hilberts et al.
2012/0100738 A1 4/2012 Palinkas et al.
2012/0149227 A1 * 6/2012 Yoshida ..... H01R 13/5202 439/277
2012/0329311 A1 * 12/2012 Duval ..... H01R 13/59 439/449
2013/0183003 A1 7/2013 Cairns
2013/0206474 A1 8/2013 Skrypka et al.
2013/0312996 A1 11/2013 Nicholson
2014/0096992 A1 4/2014 Williams et al.
2014/0097001 A1 4/2014 Campbell et al.
2014/0099812 A1 4/2014 Burrow et al.
2015/0031227 A1 1/2015 Morby et al.
2015/0111420 A1 4/2015 Zillinger et al.
2015/0200471 A1 7/2015 Melni
2015/0315877 A1 11/2015 Hamilton-Gahart et al.
2016/0211052 A1 7/2016 Williams et al.

FOREIGN PATENT DOCUMENTS

EP 0 902 505 3/1999
EP 2 386 714 11/2011
WO WO 02/103854 12/2002
WO WO 2008/113026 9/2008
WO WO 2009/097609 8/2009

* cited by examiner

CRIMPLESS ELECTRICAL CONNECTORS

BACKGROUND

Field

This disclosure relates to connectors, such as electrical connectors for transmitting power or data electronically.

Description of Certain Related Art

Electrical connectors are devices that are used to join electrical conductors using a mechanical assembly. Electrical conductors can be used to transmit power or signals. Some electrical connectors are configured to connect a free end of a first conductor to a free end of a second conductor so that electricity can pass continuously from one conductor to another. In certain arrangements, an electrical connector can be a reversible coupling that allows the connection and disconnection of the first and/or second conductor.

SUMMARY OF CERTAIN FEATURES

Various embodiments of crimpless connector assemblies are disclosed. The crimpless connectors can comprise mechanical assemblies of various components. The components can include a crimpless contact, an outer housing, and a contact facilitator. Some embodiments can include an anti-rotation pin and an activation unit. Some of the components can be easily assembled with one another by inserting one component into a receiving end or slot of another component and easily disassembled by removing the inserted component from the receiving component. Some of the components can comprise threaded shafts configured to mate with threaded lumens or channels of another component, and can be easily assembled by screwing the components together and easily disassembled by unscrewing them. In some embodiments, the threaded components of the assembly can comprise different orientations (right-handed or left-handed) which can allow selective rotation of the components with respect to each other.

The assembly can include a first configuration, a second configuration, and intermediate configurations between the first and second configurations. The first configuration can be configured for receiving a conductor and the second configuration can be configured for physically securing the conductor, such as to resist a pull-out force. The crimpless contact can be configured to receive two electrical conductors at opposite ends and to establish an electrical connection between the two. In various embodiments, the clamping force increases when a user pulls on the first conductor.

The crimpless connector can include tines on one end for compressing the first conductor and/or physically securing it in the crimpless connector. The tines can be elastically deformed in the second configuration and/or various intermediate configurations under the applied compression.

The outer housing can be configured to mate with the crimpless connector and to apply a compression force to the tines. The outer housing can include a tapered lumen which modulates the compression depending on the distance the crimpless contact is inserted into the tapered lumen. The outer housing can also be configured to be secured within an external fixation structure, such as a dielectric insulator, and can prevent rotation of the outer housing and various other components of the assembly. In some implementations, the outer housing is secured to the external fixation structure such that relative rotation of the outer housing and the external fixation structure is inhibited or prevented in at least one rotational direction. For example, the outer housing can be secured to the external fixation structure with a threaded connection.

An anti-rotation pin can secure the outer housing to the crimpless contact in a manner that prevents one from rotating relative to the other. The anti-rotation pin can limit the amount of translation along the longitudinal axis between the outer housing and crimpless contact and can thereby regulate the amount of compression force exerted on the tines.

An activation unit, such as an activation nut, can be coupled to the crimpless contact, opposite the outer housing. Rotation of the activation unit can be used to control the insertion and/or retraction of the crimpless contact in the outer housing, thereby modulating the amount of compression force applied to the first conductor by the tines of the crimpless contact. The second conductor can be inserted into the opposite end of the crimpless contact as the first conductor. In some embodiments, the second conductor can be inserted through the activation unit. The crimpless contact can be coupled to a contact facilitator for facilitating a physical and electrical connection between the second conductor and the crimpless contact.

In some embodiments, a connector comprises an outer dielectric housing, a contact activation nut, an anti-rotation feature (e.g., a pin), a contact base with a tapered surface, and a crimpless contact with multiple tines. In some embodiments, rotation of the contact activation nut transfers an axial force to the crimpless contact, which pushes the crimpless contact along the tapered surface of the contact base, which in turn causes the tines to contract radially inwardly on a conductor. In some embodiments, the contact activation nut comprises an aperture that is configured to receive a conductor and to receive a tool (e.g., a hexagonal wrench) for use in rotating the contact activation nut. In some embodiments, the anti-rotation pin resides in a longitudinal slot and inhibits rotation of the contact activation nut relative to the outer dielectric housing. Various embodiments do not require crimping to establish an electrical connection and/or to secure a conductor in the connector.

BRIEF DESCRIPTION OF THE DRAWINGS

FIG. 1A is a perspective view of the crimpless connector in a first configuration. FIG. 1B is a side cross-sectional view of the crimpless connector in a first configuration within an external structure. FIG. 1C is a side cross-sectional view of the crimpless connector in a second configuration, within the external structure, and with first and second conductors installed. FIG. 1D is an exploded view of the crimpless connector.

FIG. 2A is a perspective view of the crimpless contact. FIG. 2B is a side cross-sectional view of the crimpless contact.

FIG. 3A is a perspective view of the outer housing. FIG. 3B is a side cross-sectional view of the outer housing.

FIG. 4A is a perspective view of the contact facilitator. FIG. 4B is a side cross-sectional view of the contact facilitator.

FIG. 6A is a perspective view of the activation nut. FIG. 6B is a side cross-sectional view of the activation nut.

DETAILED DESCRIPTION OF CERTAIN EMBODIMENTS

Figure 1A:
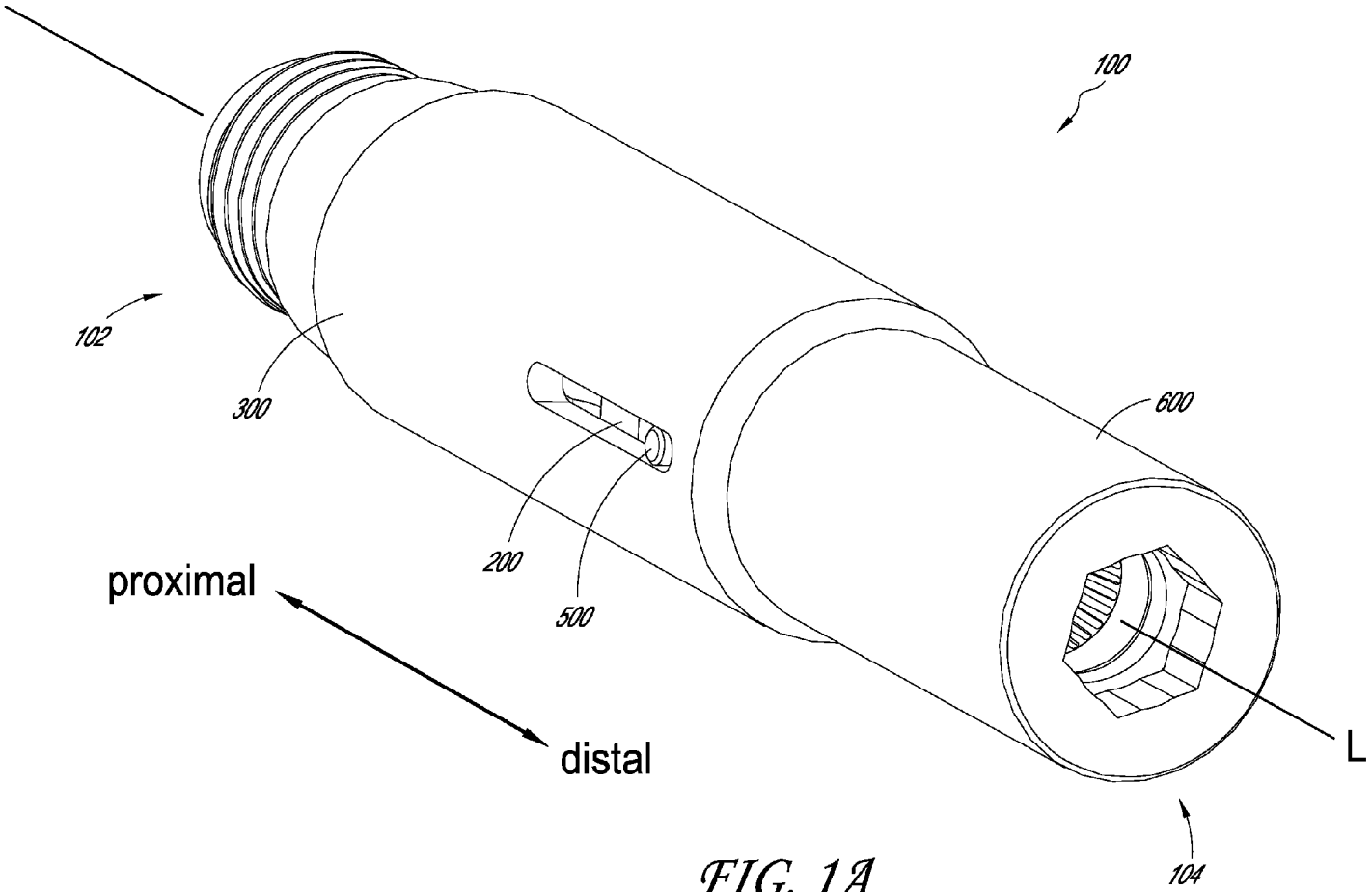
FIGS. 1A-1D illustrate an example of a crimpless connector assembly.

Various embodiments of the disclosed invention relate to connectors for electrically joining two separate electrical conductors. Several embodiments comprise a crimpless connector. A crimpless connector can provide the electrical connection between two electrical conductors without substantially plastically deforming (e.g., crimping) the crimpless connector and/or the electrical conductors in order to form the electrical connection and/or to secure at least the first conductor in the connector. Crimpless connectors can be elastically deformable to secure the electrical connection between two conductors. Several of the crimpless connectors disclosed herein can be quickly assembled and disassembled. Several embodiments do not require the use of special crimping tools (e.g., crimping pliers) to secure the conductors within the crimpless connector. In some embodiments, neither the crimpless connector nor the conductors are substantially plastically deformed. In certain implementations, the conductors can be readily removed from the crimpless connector and can be used elsewhere or reinserted into the crimpless connector. Likewise, the crimpless connector can be reused with other conductors. In some embodiments, the crimpless connector can apply substantially uniform pressure to a conductor, such as by gripping the conductor around generally the entire circumference along a length of the conductor. The amount of pressure applied by the crimpless connector to the conductor can be modulated and can be easily increased or decreased.

Overview

An example of a crimpless connector 100 is shown in FIGS. 1A-1D. As shown, the connector 100 can comprise a crimpless contact 200 and an outer housing 300. Some embodiments have a contact facilitator 400. Some embodiments include an anti-rotation pin 500 and/or an activation unit 600 (e.g., an activation nut). The components can be assembled together to comprise the crimpless connector 100 and can be unassembled as needed. The crimpless connector 100 can generally be assembled along a longitudinal axis L extending from a proximal end 102 to a distal end 104. The outer housing 300 can be positioned at the proximal end 102 and the activation nut 600 can be positioned at the distal end 104. The outer housing 300 can be configured to connect with an external fixation structure E, such as with a threaded connection. The outer housing 300 can be secured to the external structure E. The outer housing 300 can be generally fixed relative to the external structure E. The outer housing 300 can be inhibited or prevented from rotating relative to the external structure E in at least one rotational direction. In various embodiments, the external structure E comprises a dielectric insulator. In some embodiments, the external structure E extends along and/or surrounds substantially the entire longitudinal length of the connector 100.

Figure 1B:
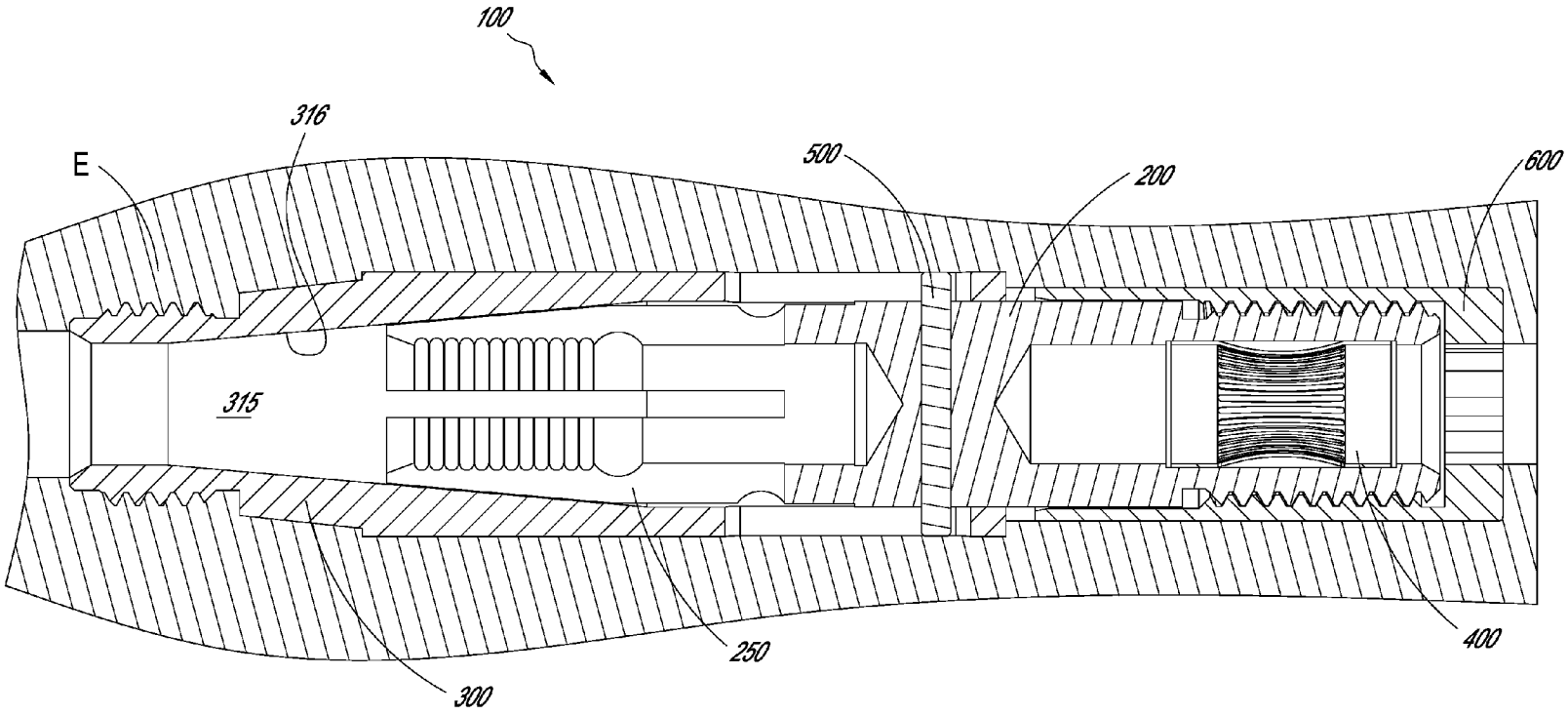
Figure 1C:
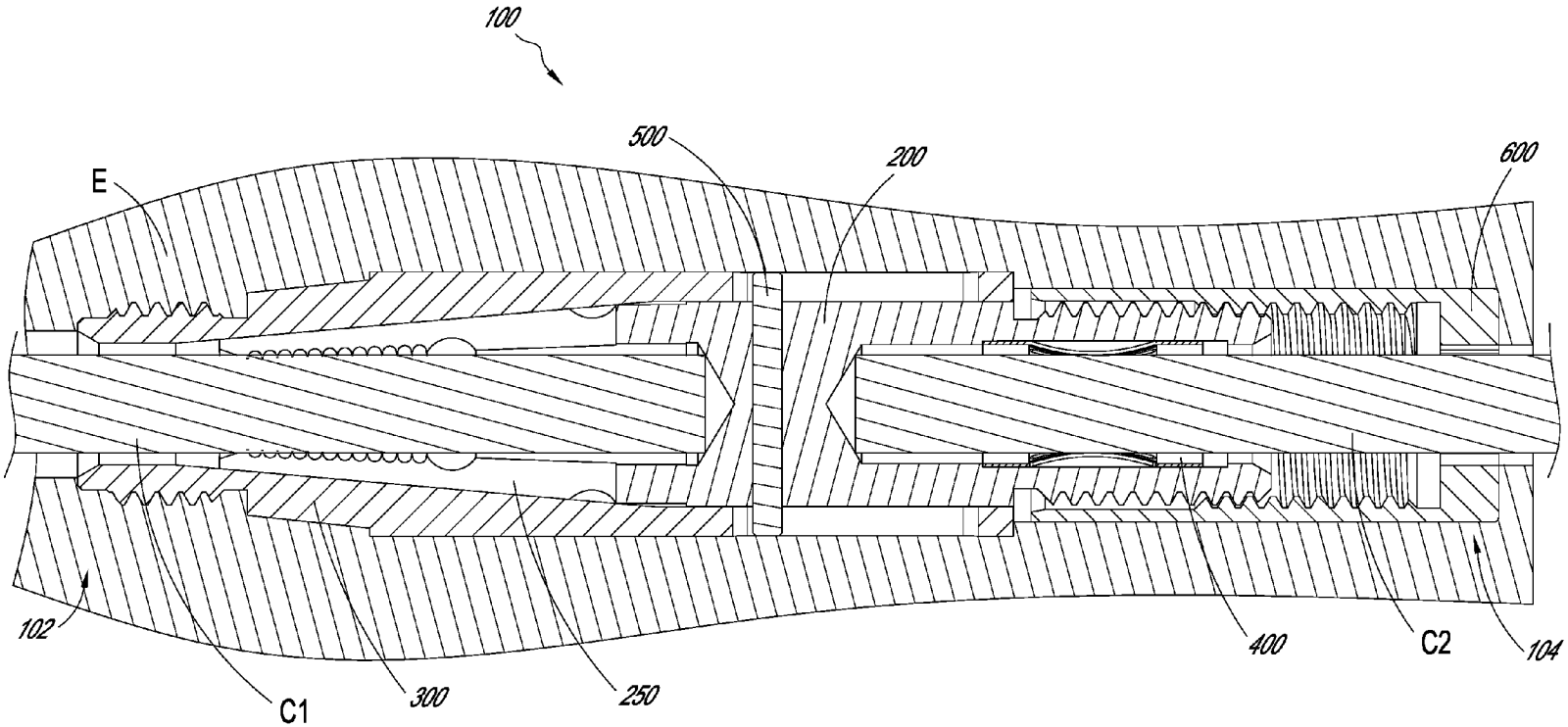
Figure 1D:
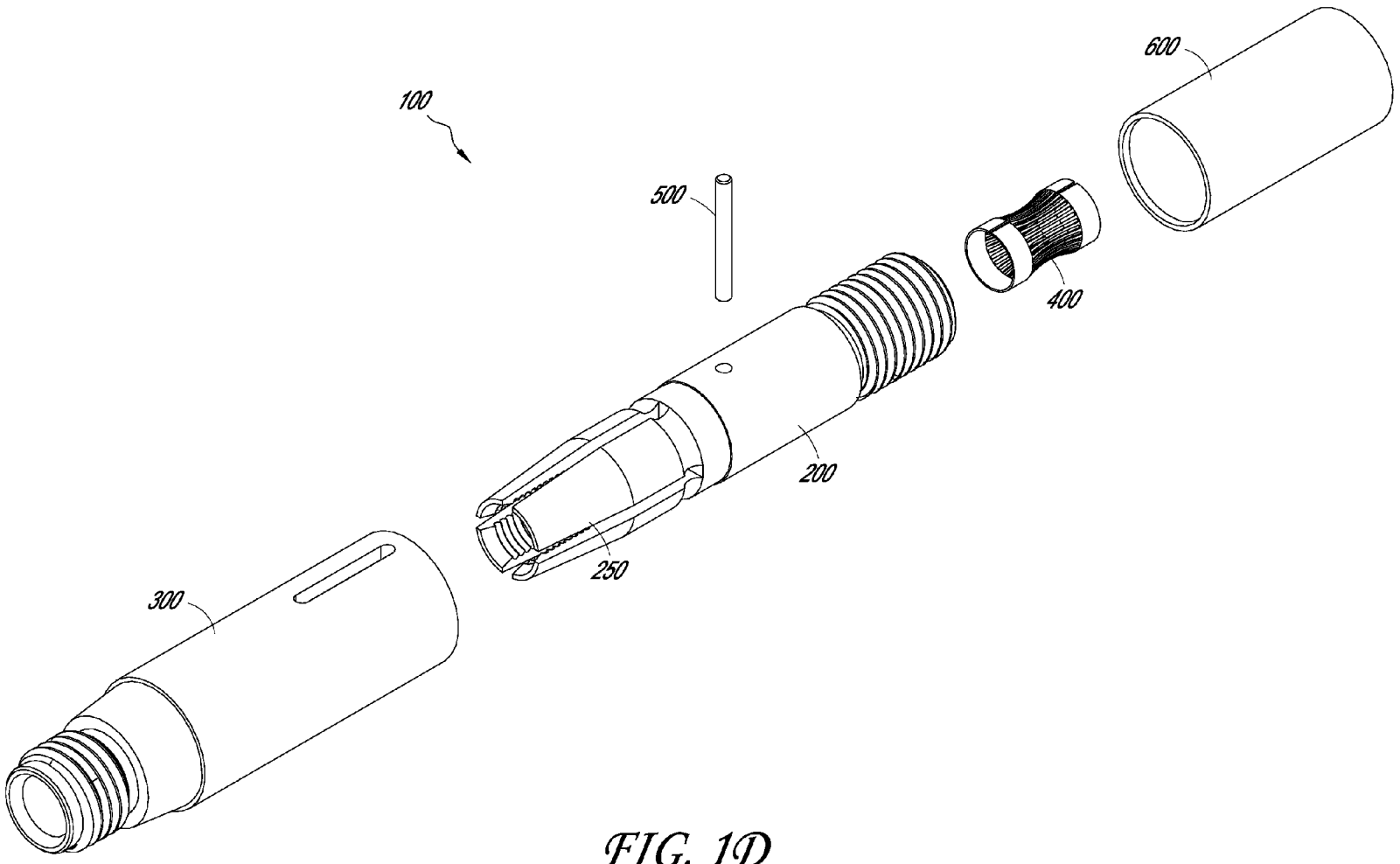

When assembled in an operative configuration, the components can be positioned in a first configuration, a second configuration, or various graduated intermediate configurations between the first and second configurations. FIG. 1B shows the crimpless connector 100 in a first configuration. In some embodiments, in the first configuration, the crimpless connector 100 is configured for receiving a first conductor C1. FIG. 1C shows the crimpless connector 100 in a second configuration. In some embodiments, in the second configuration, the crimpless connector 100 is configured for physically securing the first conductor C1. The first configuration can be a non-deformed configuration and the second configuration can be a deformed configuration. As will be described in greater detail below, the crimpless contact 200 can electrically connect two conductors (e.g., stranded cables, solid copper connectors, etc.). By physically receiving a free end of the first conductor C1 and a second conductor C2 within opposite sides of an elongate body, the crimpless connector 100 can serve as an electrical conduit between the two conductors C1, C2.

The proximal end 102 of the crimpless contact 200 can be configured with tines 250 for compressing and securing the free end of the first conductor C1. The proximal end 102 of the crimpless contact 200 can be received within a tapered lumen 315 of the outer housing 300, which can act to compress the tines 250 onto the first conductor C1. For example, the tines 250 can engage with a tapered wall 316 of the lumen 315. In some embodiments, the amount of compression is generally proportional to the distance in which the crimpless contact 200 is inserted along a longitudinal axis into the outer housing 300. The pressure applied by the tines 250 on the conductor C1 can inhibit and/or prevent retraction of the first conductor C1 from the crimpless connector 100.

In some embodiments, the crimpless contact 200 and the outer housing 300 are configured to rotate together as a unit. Some implementations include the anti-rotation pin 500 that joins the crimpless contact 200 and outer housing 300 in a manner that inhibits or prevents their rotation relative to one another about the longitudinal axis L. In some embodiments, the crimpless contact 200 and outer housing 300 are configured to translate relative to each other, such as along the longitudinal axis and/or along the direction of the taper.

As shown, the crimpless contact 200 can be threaded to engage the threads of an activation nut 600. The crimpless contact 200 and activation nut 600 can be generally aligned along a common longitudinal axis, through which a portion of the second conductor C2 can extend. Rotation of the activation nut 600 in a first direction can result in an axial separation with the crimpless contact 200 and/or can translate the crimpless contact 200. This can cause the crimpless contact 200 to move deeper into the outer housing 300. As mentioned above, the outer housing 300 can be secured to the external structure E, which can maintain the outer housing 300 in a generally fixed position relative to the external structure E. The crimpless contact 200 can move (e.g., translate) relative to the outer housing 300 and the external structure E. In some embodiments, movement of the crimpless contact 200 relative to the outer housing 300 moves the tines 250 along the tapered wall 315. This can result in the tines 250 being deformed radially inward, thereby compressing the tines 250 against the first conductor C1. In some variants, the distal end 104 of the crimpless contact 200 can include a contact facilitator 400 for facilitating electrical contact between the crimpless contact 200 and the second conductor C2. In some implementations, such as is shown in FIGS. 1B and 1C, the distal end of the activation nut 600 engages (e.g., bears against) the external structure E. In some embodiments, the external structure E inhibits or prevents the activation nut 600 and/or the housing 300 from translating relative to the external structure E. In some variants, the crimpless contact 200 and/or the pin 500 translates relative to the external structure E, such as in response to rotation of the nut 600, as will be described in more detail below. In certain variants, the proximal and distal ends 102, 104 of the connector 100 are longitudinally restrained by and/or captured in the external structure E. In some embodiments, the external structure E comprises multiple discrete components. For example, a portion of the external structure E that engages the proximal end 102 can be a separate component from a portion of the external structure E that engages the distal end 104. In some variants, the external structure E is a unitary component.

Crimpless Contact

Figure 2A:
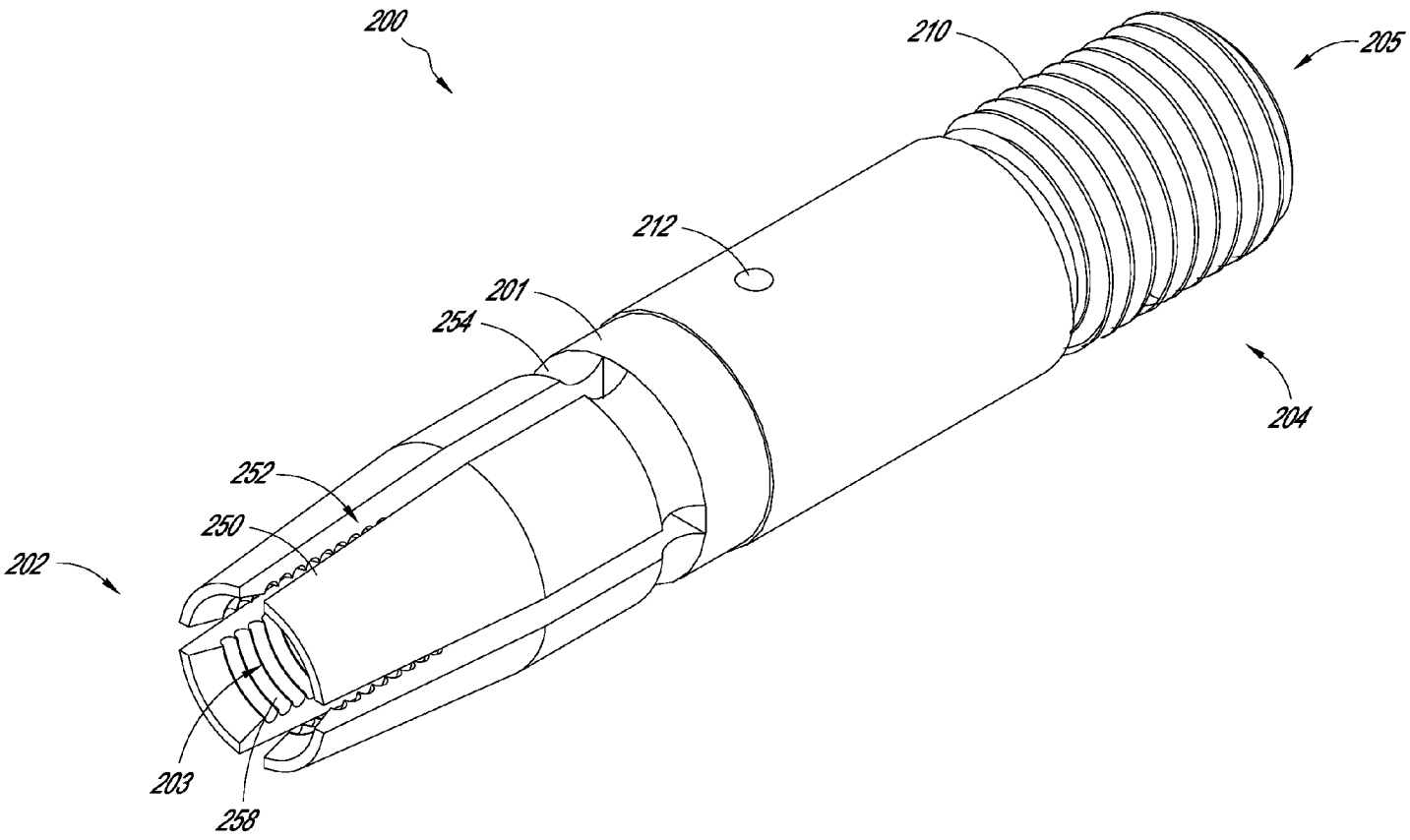
FIGS. 2A-2B illustrate an example of a crimpless contact that can be used in the connector of FIGS. 1A-1D.
Figure 2B:
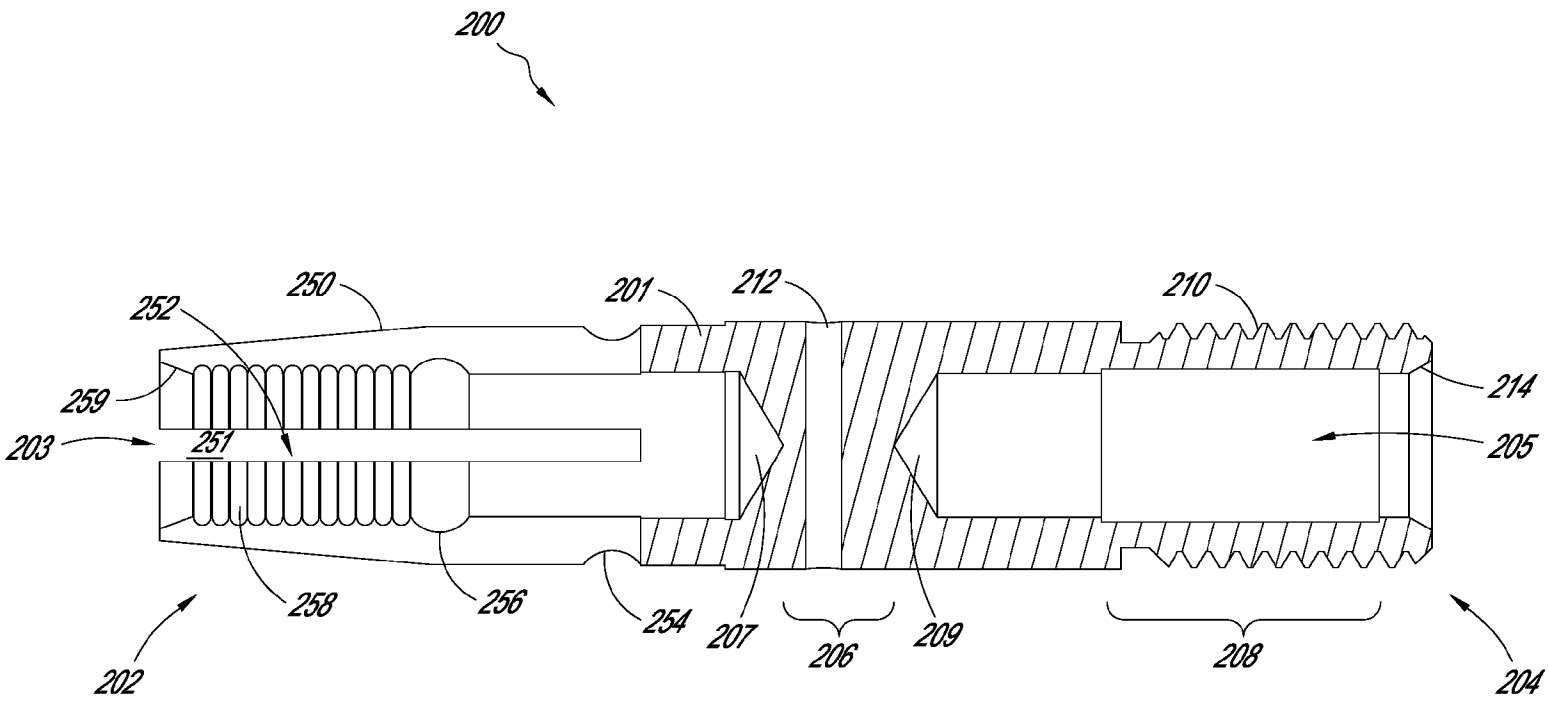

FIGS. 2A-2B illustrate an example of the crimpless contact 200. The crimpless contact 200 can be configured to receive and conduct electricity between two electrical conductors. As illustrated, the crimpless contact 200 can include an elongate body 201, comprising a proximal end 202 and a distal end 204. The elongate body 201 can be generally cylindrical or other shapes. The proximal end 202 can include tines 250 configured to receive and compress the first conductor C1. In some embodiments, the tines 250 bound a passage 251 into which the first conductor C1 is received. As discussed in more detail below, the tines 250 can be deformed, thereby changing the diameter of the passage 251.

In some embodiments, the proximal end 202 is positioned in the housing 300. The proximal end 202 can be configured to be received within the distal end 304 of the outer housing 300. In some embodiments, and/or the distal end 204 is positioned out of the housing 300, such as protruding distally out of the housing 300. The distal end 204 can comprise a threaded portion 210 configured to mate with the activation nut 600. The distal end 204 can be configured to receive the second conductor C2.

Figure 3A:
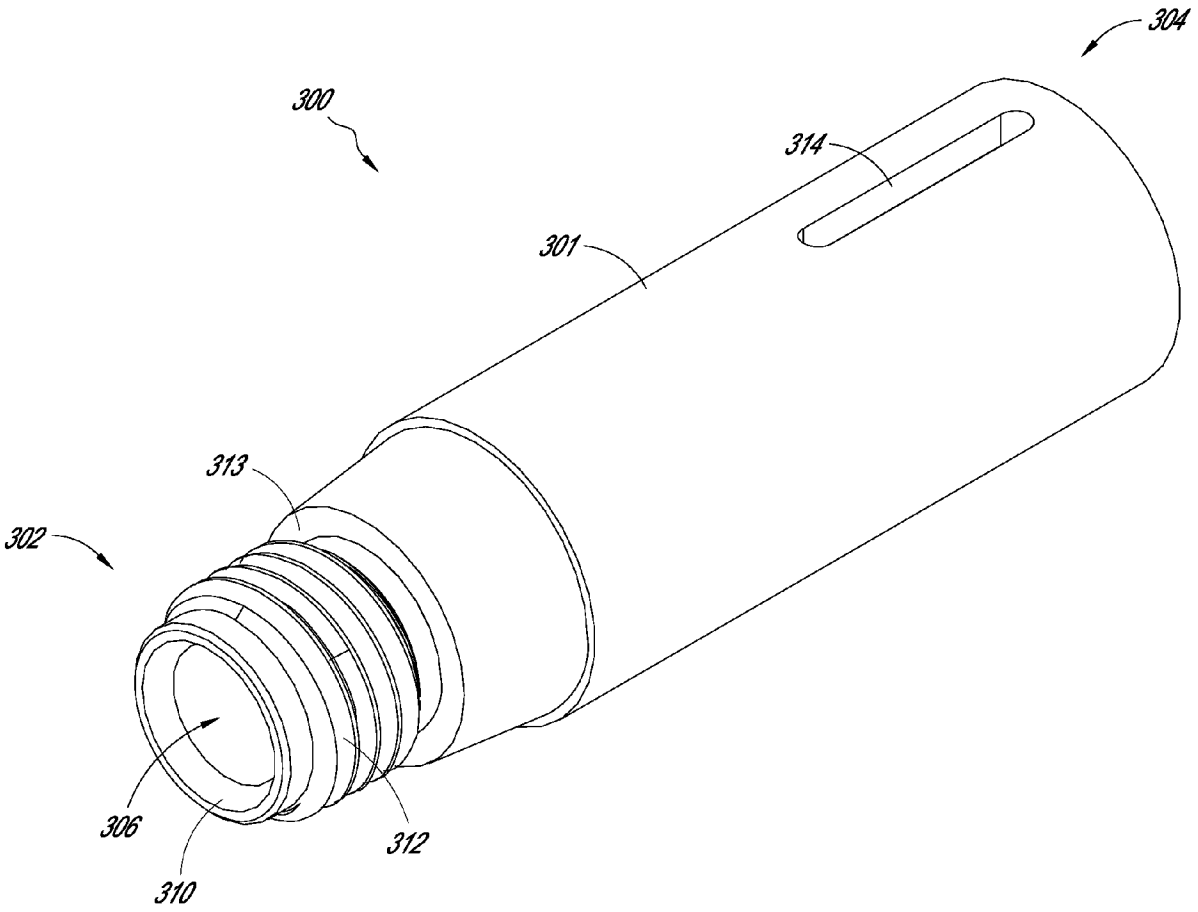
FIGS. 3A-3B illustrate an example of an outer housing that can be used in the connector of FIGS. 1A-1D.
Figure 3B:
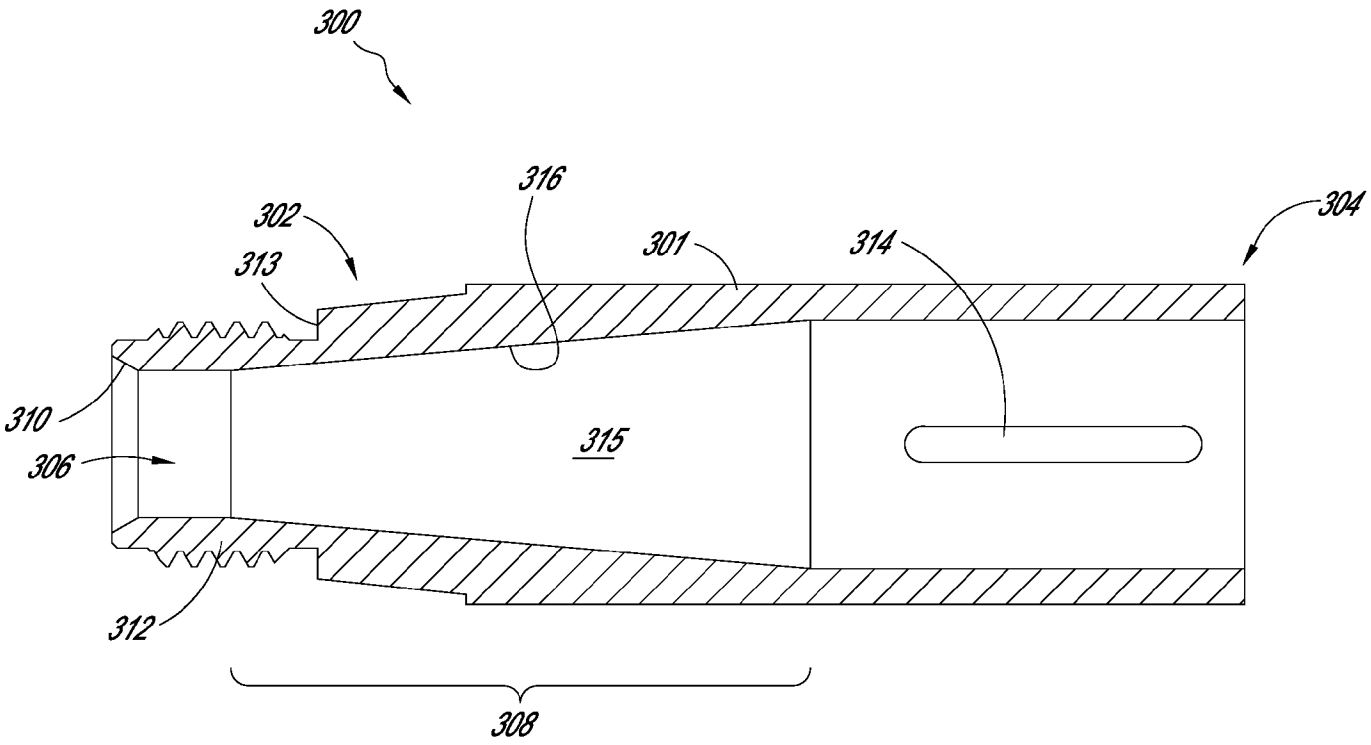

The proximal end 202 and the distal end 204 of the crimpless contact 200 can each comprise a channel 203, 205, extending from their respective end-faces along the longitudinal axis toward the longitudinal center of the crimpless contact 200. In some implementations, the proximal channel 203 and distal channel 205 can comprise similar diameters and/or can be longitudinally aligned. The crimpless contact 200 can comprise an interior portion 206 that separates inner ends 207, 209 of the channels 203, 205. The inner ends 207, 209 of the channels 203, 205 can be conically shaped for receiving the ends of the first and second conductors C1, C2, respectively. The conical inner ends 207, 209 can facilitate manufacturability of the contact 200. The length of the channels 203, 205 can be about the same, as shown in FIG. 3B, or can be different. A portion 208 of the distal channel 205 can comprise a slightly expanded diameter configured for receiving the contact facilitator 400, as shown in FIGS. 1B and 1C. The expanded diameter portion 208 can be offset from the distal end-face of the crimpless contact 200 so that the contact facilitator 400 can be secured within the distal channel 205 without easily sliding out. The open end-face of the distal end 204 of the elongate body 201 can comprise a beveled sidewall 214 for facilitating insertion of the second conductor C2 into the distal channel 205. The beveled opening can comprise an angled surface, a rounded surface, or any other suitable shape. The open end-face of the proximal end 202 of the elongate body 201 can be beveled as described below in relation to the tines 250.

The tines 250 can comprise the proximal-most end of the crimpless contact 200. The tines 250 can comprise circumferential portions of the elongate body 201. The tines 250 can be separated by slits 252. The slits 252 can extend from the proximal end-face of the elongate body 201 in a direction generally parallel to the longitudinal axis. The length of the slits 252 along the longitudinal axis can be the same as or less than the length of the proximal channel 203. The length of the slits 252 in the example of FIG. 3B is less than the length of the proximal channel 203. In some embodiments, the slits 252 radially extend between the outer diameter of the elongate body 301 and an inner diameter formed by the proximal channel 203. The slits 252 can be uniformly spaced around the circumference of the elongate body 201. The width of each of the slits 252 can be uniform and/or can be configured so that each tine 250 has an arcuate curvature (e.g., generally convex to the longitudinal axis L). In some embodiments, an arcuate curvature can facilitate compression of the tines 250 in a radial direction. Tines 250 with smaller arcs can be easier to compress radially inward than tines 250 with longer arcs. The width of each of the tines 250 can be uniform along the length of the tine 250 and/or compared to other tines 250. There can be one or more tines 250 (e.g., one, two, three, four, five, six, etc.). The example shown in FIGS. 3A-3B comprises four generally uniform width tines 250 separated by four generally uniform width slits 252. The width of the slits 252 can be larger, such as in some embodiments with fewer tines 250, to reduce the width of the tines 250. This can allow for easier deformation of the tines 250. In some embodiments, the tines 250 have a generally "C" shape in cross-section and/or at the proximal tip when viewed along the longitudinal axis from the proximal end.

As the tines 250 are radially compressed, the widths of the slits 252 can gradually decrease along the length of the tines 250 according to the amount of compression experienced. For example, when the crimpless contact 100 is positioned in the second configuration (e.g., a deformed configuration), the width of the slits 252 at the distal ends of the tines 250 can remain unchanged while the width of the slits 252 at the proximal ends of the tines 250 can be approximately zero. The width of the slits 252 can limit the amount of radial compression achievable by the tines 250. In some embodiments, in the second configuration, the proximal ends of the tines 250 come into contact with each other, thereby forming a substantially continuous circumferential surface. When the tines 250 are in contact with each other, the tines 250 can be unable to be compressed any further.

In some embodiments, the width of the slits 252 varies in the longitudinal direction. In some embodiments, the width of the slits 252 in a first configuration (e.g., a non-deformed configuration) can decrease as the slits 252 extend distally. In some variants, in the first configuration, the width of the slits 252 increases as the slits 252 extend distally. In some embodiments, the width of the tines 250 increase as the width of the slits 252 decrease. The increased width of the slits 252 at the proximal end of the tines 250 can allow for greater deformation of the tines 250.

The elongate body 201 can comprise one or more annular grooves 254, 256. The annular grooves 254, 256 can reduce the thickness of the tines 250 at certain regions, which can encourage the tines 250 to bend at those regions when under radial compression (e.g., in response to the activation nut 600 being turned). Certain embodiments, such as the example shown in FIGS. 3A-3B, include an annular groove 254 positioned along the outer circumference of the elongate body 201 and/or an annular groove 256 positioned along the inner circumference of the elongate body 201 near the middle of the tines 250. As shown, in some embodiments, the annular groove 254 is at or near the distal end of the tines 250 and/or the annular groove 256 is at or near the middle of the tines 250. The elongate body 201 can include any number of the grooves 254, 256 along the length of the tines 250 or otherwise. For example, some embodiments have one, two, three, four, five, or more of the groove 254 and/or the groove 256. The grooves 254, 256 can be positioned on the inner circumference and/or the outer circumference of the elongate body 201. In some variants, one or more of the grooves 254, 256 can be positioned on the inner circumference at a length opposite one or more grooves positioned on the outer circumference. The grooves can be generally round, as shown in FIGS. 3A-3B, or can comprise different shapes (e.g., rectangular cross-sections). The elongate body 201 can comprise grooves of different shapes and/or dimensions. The grooves may or may not extend around the entire circumference of the elongate body 201. In some variants, different tines 250 can have different groove patterns.

The thickness of the tines 250 can decrease from the distal end of the tines 250 to the proximal end-face of the elongate body 201, or along a portion therein. A reduction in the thickness can allow easier bending of the tines 250 as they are compressed by the tapered lumen of the outer housing 300. The thickness can be more greatly reduced at more proximal portions of the tines 250 because those portions can experience more compression. In some embodiments, the thickness can be decreased by tapering the outer diameter, the inner diameter, or both the outer and inner diameter of the elongate body 201. In the example shown in FIGS. 3A-3B, the outer diameter tapers inward from the second annular groove 256 to the proximal end-face, decreasing the thickness of the tines 250 toward the proximal end of the crimpless contact 200.

As shown, the tines 250 can comprise a textured surface 258. The surface 258 can be configured to engage against (e.g., bite into) the first conductor C1. The textured surface can facilitate gripping and/or securing the first conductor C1 in the contact 200. In some implementations, when under compression, the surface 258 can enhance the grip of the tines 250 on the first conductor C1. The enhanced grip can contribute to the ability of the crimpless connector 100 to resist pull-out of the first conductor C1 when the crimpless connector 100 is in a second configuration (e.g., a deformed configuration).

The textured surface 258 can comprise of any suitable texturing, such as ridges, ribs, grooves, bumps, combinations thereof, etc. In some embodiments, the surface 258 comprises a tooth or teeth. The textured surface 258 can extend over a portion or the entirety of the longitudinal length and/or the circumferential width of the tines 250. The example shown in FIGS. 2A-2B comprises a textured surface 258 formed by a series of adjacent grooves with pointed ridges between them. As illustrated, the surface 258 can extend from the second annular groove 256 to near the proximal end-face of the elongate body 201. The proximal ends of the tines 250 can comprise beveled tips 259. This can facilitate insertion of the first conductor C1 into the proximal channel 302.

The threaded portion 210 of the elongate body 201 of the crimpless contact 200 can comprise the distal most portion of the elongate body 201. The threads of the threaded portion 211 can be oriented in a first orientation (e.g., right-handed or left-handed) and can be configured to mate with a threaded channel of the activation nut 600. The length of the threaded portion 210 can be the same, greater than, or less than the length of the distal channel 205. In the example shown in FIGS. 2A-2B, the length of the threaded portion 210 is less than the length of the channel 205. The outer diameter of the threaded portion 210 can be configured to be substantially flush with the outer diameter of the adjacent non-threaded portion of the elongate body 201. In some embodiments, a non-threaded portion of the inner diameter of the activation nut 600 can slidingly engage the non-threaded portion of the outer diameter of the crimpless contact 200 when assembled together, as shown in FIGS. 1B and 1C.

The interior portion 206, which can be located longitudinally between the proximal channel 203 and the distal channel 305, can comprise a bore 212 extending through the elongate body 201. The bore 212 can be generally straight and/or generally perpendicular to the longitudinal axis. The bore 212 can pass through the longitudinal axis along a diameter of the elongate body 201. The bore 212 can comprise at least two openings within the elongate body 201. The two openings can be positioned about 180 degrees from each other. The bore 212 can be generally cylindrical.

The bore 212 can comprise a diameter configured to receive the outer diameter of an anti-rotation pin 500. The anti-rotation pin 500 can be used to secure the crimpless contact 200 to the outer housing 300 and/or to inhibit or prevent relative rotation between the crimpless contact 200 and the outer housing 300. In some embodiments, the bore 212 does not radially extend through the entire elongate body 201. For example, the bore 212 can terminate within the interior portion 206. In such embodiments, the anti-rotation pin 500 can only extend through one radial side of the outer housing 300 and crimpless contact 200 to secure the two components together. In some embodiments, the pin 500 extends through both radial sides of the outer housing 300 and the crimpless contact 200.

Outer Housing

FIGS. 3A-3B illustrate an example of the outer housing 300. The outer housing 300 can be configured to receive the proximal end of the crimpless contact 200. In various embodiments, engagement of the outer housing 300 and the crimpless contact 200 facilitates securing the crimpless contact 200 to the first conductor C1. For example, as previously mentioned, the engagement of the crimpless contact 200 and the tapered wall 316 can radially compress the tines 250 against the first conductor C1. The tines 250 can provide a clamping force on the first conductor C1. In several embodiments, the clamping force increases in response to the first conductor C1 being pulled.

As shown, the outer housing 300 can comprise an elongate body 301 that includes a proximal end 302 and a distal end 304. The elongate body 301 can be generally cylindrical. The proximal end 302 can be configured to receive and/or couple the first conductor C1 and the distal end 304 can be configured to couple with the crimpless contact 200.

The outer housing 300 can comprise a lumen 306 (also called a conduit). The lumen 306 can extend along a longitudinal axis from the proximal end 302 of the outer housing 300 to the distal end 304 of the outer housing 300. The housing lumen 306 can be generally cylindrical and can comprise an inner diameter at its distal end 304 that is configured to slidably receive the outer diameter of the proximal side of the crimpless contact 200. The open end-face of the distal end 304 of the elongate body 301 can comprise a flat-faced sidewall for abutting the activation nut 600. In some embodiments, the outer housing 300 insulates a portion of the crimpless contact 200 from the ambient environment.

In several embodiments, the housing lumen 306 comprises the tapered lumen 315. At least a portion of the length of the housing lumen 306 can comprise a decreasing inner diameter as the lumen 306 extends distally, such as from the distal end 304 toward the proximal end 302 of the outer housing 300. The length over which the inner diameter decreases comprises a tapered portion 308. The rate of change in the inner diameter can be constant such that the taper is linear. In some embodiments, the rate of change can be non-linear (e.g., the tapered portion 308 can comprise a rounded convex surface, a rounded concave surface, or a surface having incremental step changes in diameter). In some embodiments, as shown in FIG. 3B, a length of the housing lumen 306 on the distal end 304 comprises a fixed diameter and/or a length of the housing lumen 306 on the proximal end 302 comprises a fixed diameter. The length of the tapered portion 308 along the longitudinal axis can be configured to be at least the longitudinal length of the tines 250 of the crimpless contact 200.

The tapered portion 308 can be configured to coordinate and/or engage with the tines 250. In several embodiments, when the crimpless connector 100 is in the second configuration, the tines 250 extend substantially the entire longitudinal length of the tapered portion 308. The shape of the taper formed by the tapered portion 308 can match or resemble the shape of the tines 250. For example, the angle of the taper can match or approximate the angle of the outer surface of the tines 250 when they are in the second configuration. The length of the housing lumen 306 between a distal end of the tapered portion 308 and the open end-face of the distal end 304 of the elongate body 301 can be equal to or less than a length of the crimpless contact 200 between the distal end of the tines 250 and the position where the activation nut 600 sits on the crimpless contact 200 in the second configuration. The length of the housing lumen 306 between the proximal end of the tapered portion 308 and the open end-face of the proximal end 302 can comprise an inner diameter that is less than or equal to the smallest diameter of the tapered portion and can be any suitable length.

The proximal end 302 can include insertion facilitating features. In some embodiments, the proximal end 302 of the tapered portion 308 comprises the open end-face of the proximal end 302 of the elongate body 301. The open end-face of the proximal end 302 of the elongate body 301 can comprise a beveled sidewall 310. This can facilitate insertion of the first conductor C1 into the housing lumen 306. The beveled sidewall 310 can comprise an angled surface, a rounded surface, or any other suitable shape.

As illustrated, the outer diameter of the elongate body 301 can comprise a threaded portion 312. The threads of the threaded portion 312 can be oriented in a second orientation (e.g., right-handed or left-handed). The second orientation of the threads can be opposite the first orientation of threads discussed above. The threaded portion 312 can be configured to mate with threads of an external structure, such as a dielectric insulator, to which the crimpless connector 100 can be joined and/or embedded in. As shown in FIG. 3B, the outer diameter of the threaded portion 312 of the elongate body 301 can be less than the outer diameter of a distal portion of the elongate body 301. This can allow easy insertion of the threaded portion 312 into a threaded lumen of an external structure and/or can create a shoulder 313 for abutting with a surface of the external structure (e.g., when the threaded portion 312 is fully inserted). The shoulder 313 can inhibit or prevent further longitudinal translation of the outer housing 300 in the proximal direction during assembling of the crimpless connector 100 into the external structure (not shown). In some embodiments, when the threaded portion 312 is fully inserted to the point of an abutment, the threads can inhibit or prevent rotation of the outer housing 300 in a first direction (clockwise or counterclockwise). The length of the threaded portion 312 can be any suitable length. The outer housing 300 can comprise other variations in its outer diameter along the length of the elongate body 301. These variations can configure the outer housing 300 for mating with the external structure (e.g., dielectric insulating shell). In some embodiments, the housing 300 is made of a dielectric material.

The outer housing 300 can comprise one or more (e.g., two) elongated pin slots 314 in the sidewall of its elongate body 301. As shown, the pin slots 314 can be at or near the distal end 304. The pin slots 314 can be generally elongated in shape, such as having a length at least three times the width. The pin slots 314 can extend in a direction generally parallel with the longitudinal axis. The pin slots 314 can have identical shapes and lengths. The width of the pin slots 314 can be configured to receive a portion of the anti-rotation pin 500. In some embodiments, the anti-rotation pin 500 does not substantially move or rotate in a circumferential direction relative to the outer housing 300 and/or crimpless contact 200. The width of the pin slots 314 can be greater than or equal to the diameter of the bore 212 of the crimpless contact 200. The pin slot 314 can be configured to allow the anti-rotation pin 500 to translate, such as in a direction generally parallel to the longitudinal axis between a proximal end and a distal end of the pin slot 314. The pin slots 314 can be positioned about circumferentially opposite each other (e.g., about 180 degrees apart). The pin slots 314 can be substantially aligned along and/or generally parallel to the longitudinal axis. In some embodiments, the anti-rotation pin 500 extends generally perpendicularly to the longitudinal axis through one pin slot 314, across the diameter of the elongate body 301, and through the second pin slot 314.

The length of the pin slots 314 can modulate the amount of translation between the assembled outer housing 300 and the crimpless contact 200 and the total distance into the outer housing 300 that the crimpless contact 200 can extend. By doing so, the length of the pin slots 314 can modulate the amount of compression achievable by the tines 250. In some embodiments, the length of the pin slots 314 can be the same as or less than the length of the tines 250. In certain implementations, the crimpless contact 200 is not insertable to an extent where portions of the crimpless contact 200 proximal to the tines 250 are encountering and/or engaging the tapered portion 308 of the outer housing 300. Some embodiments comprise one pin slot 314 configured such that an inserted anti-rotation pin 500 is only able to extend through the one pin slot 314 and into the elongate body 301.

Contact Facilitator

Figure 4B:
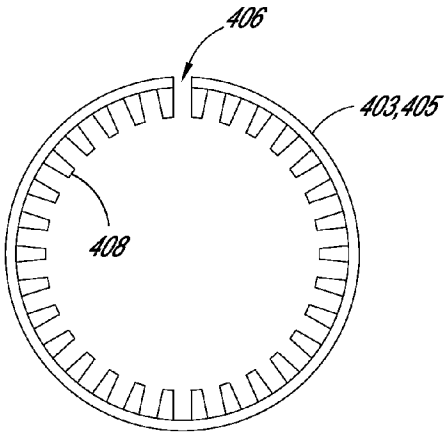
FIGS. 4A-4B illustrate an example of a contact facilitator that can be used in the connector of FIGS. 1A-1D.
Figure 4A:
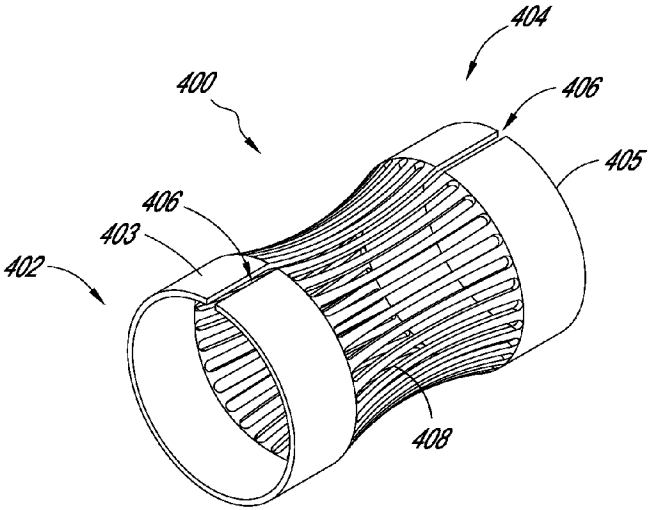

FIGS. 4A-4B illustrate an example of the contact facilitator 400. The contact facilitator 400 can be configured to be received between the distal channel 205 of the crimpless contact 200 to facilitate an electrical connection between the crimpless contact 200 and the second conductor C2, which can be inserted through the contact facilitator 400. As shown, the contact facilitator 400 can comprise a generally cylindrical body comprising a proximal end 402 and a distal end 404. The cylindrical body can include a proximal ring-like portion 403 and a distal ring-like portion 405. The proximal and distal ring-like portions 403, 405 can each comprise a thin annular body and a gap 406 extending parallel to the longitudinal axis from a proximal side to a distal side of the ring-like portion 403, 405. The gaps 406 can comprise a small fraction of the circumference of the annular bodies of the ring-like portions 403, 405. The ring-like portions 403, 405 can comprise similar or identical diameters and gaps 406 of similar or identical widths. The ring-like portions 403, 405 can be substantially circumferentially aligned so that the gaps 406 are generally aligned along a straight axis.

The contact facilitator 400 can further comprise a series of circumferentially spaced struts 408 extending between the distal end of the proximal ring-like portion 403 and the proximal end of the distal ring-like portion 405. The struts 408 can be generally parallel to the longitudinal axis and can be substantially uniformly spaced about the circumference of the contact facilitator 400. The struts 408 can have substantially uniform widths. The contact facilitator 400 can include any suitable number of struts, including, but not limited to, 1-100 struts, 3-80 struts, 4-60 struts, 5-50 struts, 6-45 struts, 8-40 struts, 10-35 struts, 20-30 struts, ranges in between, more than 100 struts, etc. The struts 408 can curve radially inward between the proximal ring-like portion 403 and the distal ring-like portion 405. The struts 408 can all have similar or identical curvatures. The struts 408 can extend a maximal radial distance inward approximately half way between the proximal ring-like portion 403 and the distal ring-like portion 405, where they comprise an inner diameter of the contact facilitator 400. The outer diameter of the proximal and distal ring-like portions 403, 405 can comprise an outer diameter of the contact facilitator 400.

The outer diameter of the contact facilitator 400 in a non-deformed configuration can be configured to be received in the expanded diameter portion 208 of the crimpless contact 200. When the ring-like portions 403, 405 are compressed radially inward, they can temporarily assume a diminished diameter configuration configured to be received through the distal-most portion of the distal channel 205. The width of the gaps 406 in the circumferences of the ring-like portions 403, 405 can be temporarily reduced when the ring-like portions 403, 405 are compressed (e.g., the width of the gaps can be reduced to about zero). The length of the contact facilitator 400 in a non-deformed configuration can be slightly less than the length of the expanded diameter portion 208 of the crimpless contact 200. The struts 408 can be configured to be pressed radially outward by the second conductor C2 when the second conductor C2 is inserted through the contact facilitator 400. When pressed radially outward, the curvature of the struts 408 can be reduced, expanding the length of the struts 408 along a proximal-to-distal direction and increasing the separation distance between the proximal and distal ring-like portions 403, 405. The length of the expanded diameter portion 208 of the crimpless contact can be configured to accommodate the expanded length of the contact facilitator when deformed by the second conductor C2.

Anti-Rotation Pin

Figure 5:
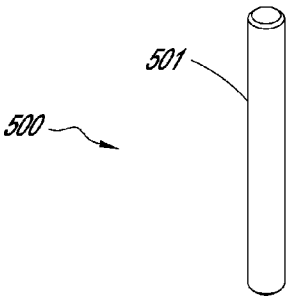
FIG. 5 illustrates a perspective view of an example of an anti-rotation pin that can be used in the connector of FIGS. 1A-1D.

FIG. 5 illustrates an example of the anti-rotation pin 500. Some implementations of the crimpless connector 100 can include an anti-rotation pin 500 configured to inhibit or prevent the crimpless contact 200 and the outer housing 300 from rotating relative to one another about the longitudinal axis of the connector 100. As shown, the anti-rotation pin 500 can comprise an elongate body 501. The anti-rotation pin 500 can be generally cylindrical. The cross-sectional view of the crimpless connector 100 shown in FIG. 1B illustrates the anti-rotation pin 500 assembled with the crimpless contact 200 and the outer housing 300 in a first configuration. FIG. 1C illustrates the anti-rotation pin 500 assembled with the crimpless contact 200 and the outer housing 300 in a second configuration.

As mentioned above, the anti-rotation pin 500 can be configured to be received within the bore 212 of the crimpless contact 200 and/or the pin slots 314 of the outer housing 300. The anti-rotation pin 500 can comprise a length greater than or equal to the length of the bore 212 of the crimpless contact 200 and/or a length greater than or equal to the outer diameter of the distal end 304 of the elongate body 301 of the outer housing 300. The anti-rotation pin 500 can extend the entire length of the bore 212 and extend into or through one or two pin slots 314, thereby substantially securing the outer housing 300 and the crimpless contact 200 together in the circumferential direction. The length of the anti-rotation pin 500 can be less than or equal to the outer diameter of the distal end 304 of the elongate body 301 of the outer housing 300. The diameter of the anti-rotation pin 500 can be slightly less than the diameter of the bore 212 and/or slightly less than the width of the pin slots 314.

Activation Unit

Figure 6A:
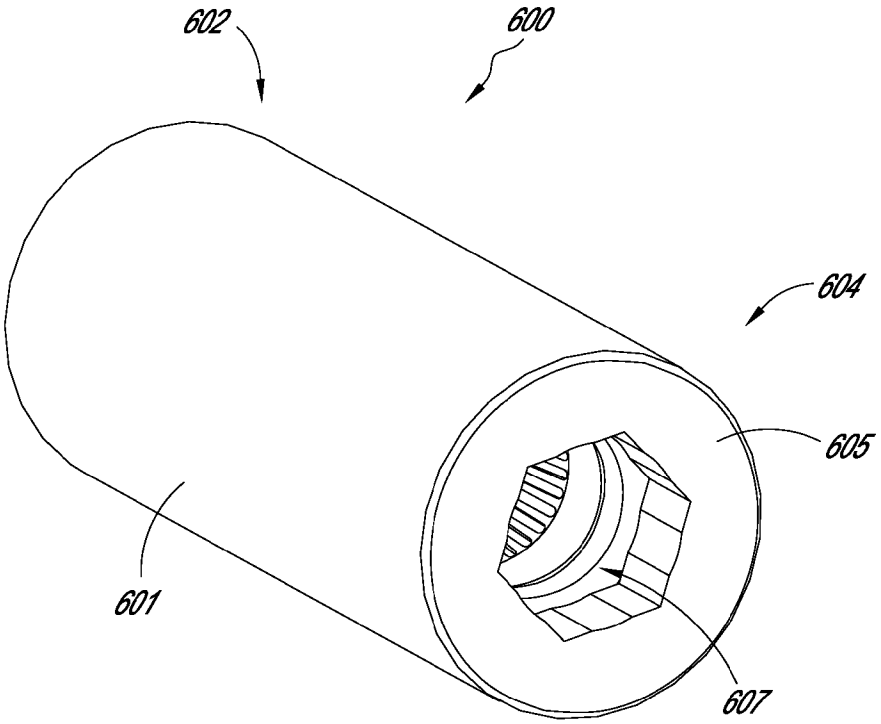
FIGS. 6A-6B illustrate an example of an activation nut that can be used in the connector of FIGS. 1A-1D.
Figure 6B:
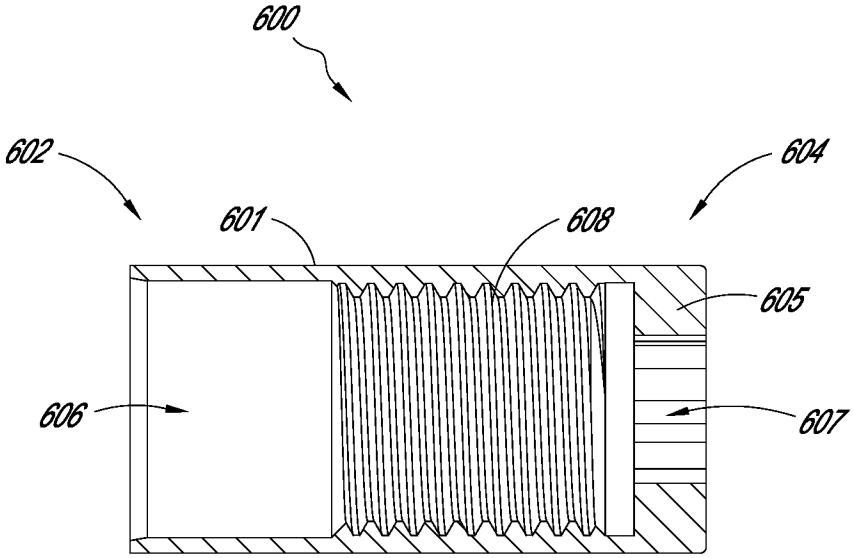

FIGS. 6A-6B illustrate an example of the activation unit 600. The activation unit 600 can be operatively configured to transition the crimpless connector 100 between the first configuration (e.g., for allowing easy insertion and removal of the first conductor C1) and the second configuration (e.g., for resisting pull-out of the first conductor C1). As shown, the activation unit 600 can generally be configured as an activation nut. The activation nut 600 can be configured to receive the distal end 204 of the crimpless contact 200. The activation nut 600 can comprise a generally cylindrical body 601 having a proximal end 602 and a distal end 604. The proximal end 602 can comprise a generally open end-face and the distal end 604 can comprise a flat, generally closed end-face 605.

The activation nut 600 can include a channel 606 extending from the proximal open end-face 602 to the proximal side of the distal closed end-face 605. The channel 606 can comprise a threaded portion 608. The threaded portion 608 can be positioned near the distal end of the channel 606 and can be configured to mate with the threaded portion 212 of the crimpless contact 200. The length of the threaded portion 608 of the channel 606 can be greater than or equal to the length of the threaded portion 212 of the crimpless contact 200. The threads of the threaded portion 608 can be oriented in a first orientation (e.g., right-handed or left-handed). The first orientation can be opposite the second orientation of the threaded portion 312 of the outer housing 300. For example, the threaded portion 608 can comprise right-hand threading and the threaded portion 212 can comprise left-hand threading, or vice versa. The opposite threading can reduce the chance of the crimpless connector 100 being unthreaded from the external structure (e.g., dielectric shell) when the activation nut 600 is turned.

The channel 606 can comprise an unthreaded portion proximal to the threaded portion 608. The unthreaded portion can be configured to slidably receive the outer diameter of the distal end 204 of the crimpless contact 200, such as an unthreaded portion proximal to the threaded portion 212 of the crimpless contact 200. The length of the unthreaded portion can extend such that the proximal end 602 of the activation nut 600 abuts the outer housing 300. In some embodiments, the activation nut 600 can aid in insulating portions of the crimpless contact 300 from the ambient environment.

The closed-end face 605 can include an aperture 607. The aperture 607 can extend from the proximal side to the distal side of the closed-end face 605. The aperture 607 can be generally aligned along the longitudinal axis. The aperture 607 can be configured to receive the second conductor C2. The second conductor C2 can extend through the aperture 607 of the activation nut 600 into the distal channel 205 of the crimpless contact 200. The aperture 607 can be configured to receive an activation tool (e.g., a hexagonal wrench) for rotating the activation nut 600, thereby transitioning the crimpless contact 200 between the first and second configurations. The aperture 607 can be polygonal (e.g., pentagonal, hexagonal, octagonal, etc.) or any shape configured to mate with a complementary shaped or at least partially complementary shaped activation tool. The activation tool can rotate the activation nut 600 by applying a torque to the activation nut 600 about the longitudinal axis. The closed end-face 605 can be sufficiently thick and/or strong for the activation tool to frictionally mate with the aperture 607.

In some embodiments, the activation nut 600 can be turned by applying a torque to the outer diameter of the activation nut 600. In certain implementations, the outer diameter of a portion of the activation nut 600 can be configured to facilitate the application of torque to the activation nut 600. For example, the outer diameter can comprise one or more flattened surfaces or can be polygonal for mating with a wrench or other suitable activation tool. In some implementations, the activation nut 600 can be manually turned by a user without the use of an activation tool. A portion of the outer surface of the activation nut 600 can be textured for facilitating the grip of a user.

Assembly, Disassembly, and Operation of the Connector

Various components disclosed herein can be reversibly assembled into the crimpless connector 100. Referring back to FIGS. 1A-1C, an example of the assembled crimpless connector 100 is shown. FIGS. 1A and 1B depict the crimpless connector in the first configuration (a non-deformed configuration). FIG. 1C depicts the crimpless connector in the second configuration (a deformed configuration). The components can generally be assembled in any order. In some implementations, the contact facilitator 400 is configured to be inserted into the crimpless contact 200 prior to coupling the crimpless contact 200 with the activation nut 600. In some implementations, the anti-rotation pin 500 is configured to be inserted through the crimpless connector 100 after the coupling of the crimpless contact 200 and the outer housing 300.

The proximal end 202 of the crimpless contact 200 can be received in the distal end 304 of the outer housing 300. A user (e.g., an assembler) can slidably insert the proximal end 202 of the crimpless contact 200 into the outer housing 300 approximately until a point where a resistance is sensed. The resistance can be caused by the frictional interaction between the tines 250 and the tapered portion 308 of the outer housing 300. The assembler can rotate the crimpless contact 200 in either direction until an opening to the bore 212 in the crimpless contact 200 is visibly aligned with a pin slot 314 in the outer housing. The assembler can align the pin slot 314 with the bore 212, such as prior to or during the insertion of the crimpless contact 200 into the outer housing 300. In some embodiments, the connector 100 is configured to enable the assembler to gauge the length of insertion by visually discerning the longitudinal alignment of the bore 212 within the length a pin slot 314. The assembler can adjust the length of insertion so that the bore 212 is aligned at the distal end of a pin slot 314. This configuration can comprise the first configuration.

In some embodiments, the first configuration comprises a non-deformed configuration, in which the tines 250 are not compressed radially inward and the width of the slits 252 between the tines 250 remains substantially unchanged. In some embodiments, the first configuration comprises a slightly deformed configuration. For example, the tines 250 can be compressed radially inward such that the passage 251 has a diameter greater than the diameter of the first conductor C1 but less than the diameter of the passage 251 when the crimpless contact 200 is separate from the outer housing 300. The portion of the tines 250 received within the tapered portion 308 of the outer housing 300 in the first configuration can be configured with an outer diameter that decreases in the proximal direction to create angled surface. The angled surface of the non-deformed tines 250 can generally match the taper of the tapered portion 308.

In some embodiments, when the bore 212 in the crimpless contact 200 is circumferentially and longitudinally aligned with a pin slot 314 of the outer housing 300, the anti-rotation pin 500 can be inserted through the pin slot 314 and into the bore 312. In the example shown in FIGS. 1A-1C, the outer housing 300 comprises two circumferentially and longitudinally aligned pin slots 314. The anti-rotation pin 500 can be inserted through the crimpless contact 200 such that the anti-rotation pin 500 extends through both pin slots 314. The anti-rotation pin 500 can be a length sufficient to extend through a diameter of the crimpless contact 200 and into both pin slots 314. The length can be configured not to expand the cross-sectional profile of the crimpless connector 100, which can be advantageous for inserting (e.g., slidably inserting) the crimpless contact 100 in an external channel, such as the channel of a dielectric insulator. In some embodiments, the bore 212 in the crimpless contact 200 can terminate in the interior portion 206 of the crimpless contact 200 and/or the outer housing 300 can comprise only one pin slot 314. During assembly of the anti-rotation pin 500 with the crimpless contact 200 and the outer housing 300, the anti-rotation pin 500 can inhibit or prevent rotation in either a first or second direction (clockwise or counterclockwise) around the longitudinal axis of the crimpless contact 200 and the outer housing 300 relative to one another.

The contact facilitator 400 can be received in the distal channel 205 of the crimpless contact 200. The contact facilitator 400 can be configured to be compressed radially inward so that it can be received through the distal end of the distal channel 205 of the crimpless contact 200. The contact facilitator 400 can be compressed by applying pressure to the circumference of the proximal ring-like portion 403 and/or the distal ring-like portion 405 to temporarily decrease the outer diameter of the contact facilitator 400 by decreasing the width of the gaps 406 in the outer circumference of the ring like portions 403, 405. The compressed outer diameter of the deformed contact facilitator 400 can be configured to be slightly less than the diameter of the distal channel 205 at the distal end-face of the crimpless contact 200. The proximal ring-like portion 403 and the distal ring-like portion 405 can be compressed (e.g., by the assembler) simultaneously or just prior to the insertion of each ring like portion 403, 405 into the distal channel 205. The contact facilitator 400 can be pushed proximally into the distal channel 205 until it comes to sit in the expanded diameter portion 208 of the distal channel 205. In the expanded diameter portion 208, the contact facilitator 400 may or may not remain at least partially compressed. The outer diameter of the contact facilitator 400 can be configured to contact the elongate body 201 of the crimpless contact 200 along the length of the partially expanded portion 208 to establish an electrical connection.

The distal end 204 of the crimpless contact 200 can be received in the proximal end 602 of the activation nut 600. The activation nut 600 can be coupled to the distal end 204 of the crimpless contact 200 by slidably inserting the distal end 204 of the crimpless contact 200 into the channel 606 until the threaded portion 210 of the elongate body 201 of the crimpless contact 200 encounters the threaded portion 608 of the channel 606 of the activation nut 600. The activation nut 600 can then be rotated in a second direction (e.g., clockwise or counterclockwise) to engage the threads of the threaded portion 210 and threaded portion 608. As shown in FIG. 1B, the activation nut 600 can be threaded onto the distal end 204 of the crimpless contact 200 until the distal end 204 of the crimpless contact 200 abuts the proximal side of the distal closed end-face 605 and/or until the proximal end 602 of the activation nut 600 abuts the distal end 304 of the outer housing 300. In some embodiments, this puts the crimpless connector 100 in the first configuration. In the first configuration of the crimpless connector 100, the axial separation along the longitudinal axis between the distal end 204 of the crimpless contact 200 and the proximal side of the face 605 of the activation nut 600 can be at a minimum.

The first conductor C1 can be inserted into the proximal end 102 of the crimpless connector 100. A free end of the first conductor C1 can be received through the open end-face of the proximal end 302 of the outer housing 300 and by the proximal channel 203 of the crimpless contact 200. The first conductor C1 can be inserted so that the free end abuts the end of the proximal channel 203. The first conductor C1 can be inserted after assembly of the crimpless contact 200 and outer housing 300 or after assembly of the entire crimpless connector 100. The crimpless connector 100 can be configured to receive the first conductor C1 when in the first configuration (e.g., a non-deformed configuration) and/or to physically secure the first conductor C1, inhibiting and/or preventing pull-out, in the second configuration (e.g., a deformed configuration). In several embodiments, connector 100 is configured such that the securement (e.g., clamping force) of the first conductor C1 in the connector 100 increases in response to a pulling force on the first conductor C1.

The crimpless connector 100 can be transitioned between the first configuration and the second configuration by rotation of the activation nut 600 about the longitudinal axis. Rotation in a first direction (clockwise or counterclockwise) can transition the crimpless connector 100 from the first configuration to the second configuration, while rotation in a second, opposite direction can transition the crimpless connector 100 from the second configuration to the first configuration. The activation nut 600 can be rotated by applying a torque in a first or second direction to the activation nut 600 via an activation tool (e.g., an Allen key) inserted in the aperture 607 of the activation nut 600. In some embodiments, the assembler can apply a torque to the outer circumference of the activation nut 600 (e.g., by manually turning the activation nut 600). The crimpless contact 200 can be prevented from rotating in the same direction as the activation nut 600 by the anti-rotation pin 500. The anti-rotation pin 500 can be prevented from rotating in the same direction as the activation nut 600 by the outer housing 200. The outer housing 200 can be prevented by rotating in the same direction as the activation nut 600 by an externally applied force. The external force can be applied manually by the assembler or can be applied by an externally coupled structure, such as a dielectric insulator. For example, if the threaded portion 312 of the outer housing 300 is engaged with a threaded lumen in a fixated external structure, the external structure can prevent rotation of the outer housing 200.

As mentioned above, the threaded portion 608 of the activation nut 600 and the complementary threaded portion 210 of the crimpless contact 200 can be configured in a first orientation and the threaded portion 312 of the outer housing 300 and a complementary threaded lumen of an external structure can be configured in a second orientation, opposite the first orientation. In some embodiments, rotation of the activation nut 600 in a first rotational direction unthreads a portion of the crimpless contact 200 out of threaded engagement with the activation nut 600, thereby translating the crimpless contact 200, as can be seen from FIGS. 1B and 1C. In some embodiments, rotation in the first direction of the activation nut 600 further tightens the threaded engagement between the threaded portion 312 of the outer housing 300 and the external structure.

In certain variants, rotation of the activation nut 600 in a first direction can increase the separation distance between the face 605 of the activation nut 600 and the distal end 204 of the crimpless contact 200, while rotation of the outer housing 200 in the first direction can decrease the separation distance between the outer housing 300 and an external structure. If the separation distance between the outer housing 300 and external structure is incapable of being decreased, the two components can be incapable of rotating relative to one another. For instance, if the shoulder 313 of the outer housing 300 is abutting a corresponding shoulder of the fixated external structure (e.g., the outer housing 300 cannot move further in the proximal direction), the outer housing 300 can be inhibited or prevented from rotating in the first direction around the longitudinal axis. Frictional resistance between the elongate body 301 of the outer housing 300 and a corresponding channel of an external structure can also inhibit rotation of the outer housing 300.

In some embodiments, an external structure can be assembled around the crimpless connector 100, confining it to a channel of a fixed length. The fixed length of the channel in the external structure can inhibit or prevent the axial separation of the outer housing 300 if engaged with a threaded lumen of the external structure, even if the threads of the outer housing 300, external structure, crimpless contact 200, and activation nut 600 all are configured with the same orientation (right handed or left handed). The outer housing 300 can rotationally fix the anti-rotation pin 500, preventing it from rotating around the longitudinal axis. The anti-rotation pin 500 can inhibit or prevent the crimpless contact 200 from rotating around the longitudinal axis. In certain embodiments, the connector 100 has a substantially constant longitudinal length. For example, as can be seen in FIGS. 1B and 1C, the longitudinal length in the first configuration can be substantially equal to the longitudinal length in the second configuration. In some variants, the connector 100 has a variable longitudinal length.

In various embodiments, rotation of the activation nut 600 results in translation of the crimpless contact 200 relative to the activation nut 600 and/or the outer housing 300. For example, in some implementations, when the crimpless contact 200 is fixed so that it cannot rotate in the first direction, rotation of the activation nut 600 in the first direction can force an increase in the separation distance between the activation nut 600 and the crimpless contact 200.

If movement of the activation nut 600 in the distal direction is prohibited or inhibited (e.g., by the external structure E or a manually applied force in the distal direction during rotation), the crimpless contact 200 will be induced to translate in the proximal direction. In some embodiments, an external structure can be assembled around the crimpless connector 100. The external structure can include a neck portion that allows the activation tool to access the activation nut 600 which inhibits or prevents movement of the activation nut 600 in a distal direction.

Various embodiments provide movement of the crimpless contact 200 in a proximal direction during rotation of the activation nut 600 in the first direction. If the outer housing 300 is axially fixed along the longitudinal axis (e.g., by an external structure abutting should 313), the proximal end 202 of the crimpless contact 200 will be forced further inside the lumen 306 of the outer housing 300 by a distance equivalent to the change in distance between the face 605 of the activation nut 600 and the distal end 204 of the crimpless contact 200.

In various embodiments, the crimpless contact 200 can be engaged with the tapered portion 308 of the lumen 306 of the outer housing 300. For example, during rotation of the activation nut 600 in the first direction, the tines 250 of the crimpless contact 200 can be forced against the tapered portion 308 of the lumen 306 of the outer housing 300. The tines 250 can be compressed radially inward by the decreasing diameter of the tapered portion 308. The compression of the tines 250 can force the tines 250 around the circumference of the first conductor C1. In some embodiments, the tines 250 apply substantially uniform pressure around the circumference of the first conductor C1. The textured surface 258 can facilitate the grip of the tines 250 on the first conductor C1 along a length of the tines 250. The pressure applied by the tines 250 in the second configuration and/or in intermediate configurations between the first and second configurations can apply a counterforce to a retraction force on the first conductor C1, which helps the first conductor C1 resist pull-out. The pressure applied by the tines 250 can ensure a good electrical connection between the first conductor C1 and the crimpless contact 200.

In various embodiments, the crimpless connector 100 is configured to avoid or reduce pulling or retracting the first conductor C1 into the outer housing 300 and/or crimpless contact 200 during assembly and/or operation. This can reduce strain on the first conductor C1 and/or can reduce the likelihood of the first conductor C1 becoming disconnected at another location (e.g., at another end of the first conductor C1). In some implementations, the crimpless connector 100 pushes a portion of the first conductor C1 out of the crimpless connector 100 in transitioning from the first to the second configuration. In some embodiments, as the tines 250 are being radially compressed and/or during rotation of the activation nut 600 in a first direction, a portion of the first conductor C1 is moved axially a distance out of the connector 100.

As the crimpless contact 200 transitions between the first configuration and second configuration, the anti-rotation pin 500 can slide along the length of the pin slots 314 from the distal ends of the pin slots 314 to the proximal ends of the pin slots 314. The proximal ends of the pin slots 314 can limit the amount of translation of the crimpless contact 200 and can inhibit the activation nut 600 from rotating when the second configuration is achieved. Some embodiments of the crimpless connector 100 do not comprise an activation nut 600. In certain embodiments, the crimpless contact 200 can be inserted or retracted from the outer housing 300 by the direct manual application of a force in the proximal or distal direction, respectively.

In some embodiments, the second conductor C2 is inserted into the crimpless connector 100. In some embodiments, this occurs after securing the first conductor C1 and/or after the activation tool has been removed from the aperture 607 of the activation nut 600. A free end of the second conductor C2 can be received through the aperture 607 of the activation nut 600 and by the distal channel 205 of the crimpless contact 200. The second conductor C2 can be inserted so that the free end abuts the end of the distal channel 205. Upon insertion of the second conductor C2, the outer diameter of the second conductor C2 can be greater than the inner diameter of the contact facilitator 400 in a non-deformed or partially deformed state. The second conductor C2 can press against the struts 408 of the contact facilitator 400 forcing the inner diameter of the contact facilitator 400 to expand as the struts 408 are forced to partially straighten, reducing the curvature of the struts 408. As the struts 408 are pressed outward, the length of the contact facilitator 400 can increase as the proximal and distal ring-like portions 403, 405 are forced further apart. The length of the expanded portion 208 of the distal channel 205 can limit the expansion of the contact facilitator 400. In some embodiments, the struts 408 of the contact facilitator can continue to be deformed even after the contact facilitator 400 has expanded to the full length of the expanded portion 208 of the distal channel 205.

After insertion of the second conductor C2, the struts 408 can apply physical pressure to the outer circumference of the second conductor C2, thereby facilitating a good electrical connection between the second conductor C2 and the contact facilitator 400. The contact facilitator 400 can be pressed into the expanded portion 208 of the distal channel 205 of the crimpless contact 200 by the second conductor C2 and/or the contact facilitator 400 can exert a counterforce on the crimpless contact 200 if the expanded portion 208 of the distal channel 205 of the crimpless contact 200 is configured to compress the contact facilitator 400 into at least a partially deformed state. The pressure exerted by the contact facilitator 400 on the crimpless contact 200 can facilitate a good electrical connection between the contact facilitator 400 and the crimpless contact 200. The crimpless contact 200 can establish an electrical connection between the first conductor C1 and the second conductor C2 in the second configuration. In some embodiments, the crimpless contact 200 establishes an electrical connection between the first and second conductors C1, C2 in the first configuration and/or intermediate configurations.

Upon removal of the second conductor C2, rotation of the activation nut 600 can transition the crimpless connector from the second configuration to the first configuration, facilitating the removal of the first conductor C1 from the proximal end 202 of the crimpless contact 200. The crimpless connector 100 can easily be disassembled as needed by reversing the steps employed to assemble each component to another component. The crimpless connector 100 can be reusable and can be repeatedly assembled and disassembled as needed. The first and second conductors C1, C2 can also be reused upon removal from the crimpless connector 100.

Certain Terminology

Although connectors have been disclosed in the context of certain embodiments and examples, it will be understood by those skilled in the art that the connectors extend beyond the specifically disclosed embodiments to other alternative embodiments and/or uses of the embodiments and certain modifications and equivalents thereof. Use with any structure is expressly within the scope of this invention. Various features and aspects of the disclosed embodiments can be combined with or substituted for one another in order to form varying modes of the assembly. The scope of this disclosure should not be limited by the particular disclosed embodiments described herein.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features can be described above as acting in certain combinations, one or more features from a claimed combination can, in some cases, be excised from the combination, and the combination can be claimed as any subcombination or variation of any subcombination.

Terms of orientation used herein, such as "top," "bottom," "proximal," "distal," "longitudinal," "lateral," and "end" are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. can be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context can dictate, the terms "approximately", "about", and "substantially" can refer to an amount that is within less than or equal to 10% of the stated amount. The term "generally" as used herein represents a value, amount, or characteristic that predominantly includes or tends toward a particular value, amount, or characteristic. As an example, in certain embodiments, as the context can dictate, the term "generally parallel" can refer to something that departs from exactly parallel by less than or equal to 20 degrees.

Some embodiments have been described in connection with the accompanying drawings. The figures are to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein can be practiced using any device suitable for performing the recited steps.

SUMMARY

In summary, various embodiments and examples of connectors have been disclosed. Although the connectors have been disclosed in the context of those embodiments and examples, this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims that follow.

The invention claimed is:

1. An electrical connector assembly for connecting a first conductor and a second conductor, the connector assembly comprising:

a housing comprising a lumen and an inner surface, the inner surface comprising a tapered portion having a first diameter at a proximal end and a second diameter at a distal end, the first diameter being less than the second diameter, the housing being configured to connect with an external dielectric structure;

a contact configured to conduct electricity, the contact comprising:

a proximal end that is received in the housing, the proximal end comprising a plurality of elastically deformable tines, the tines bounding a passage that is configured to receive the first conductor; and a distal end comprising a threaded outer surface and a distal channel, the distal channel configured to receive the second conductor;

an anti-rotation feature configured to inhibit relative rotation of the contact and the housing; and an activation nut comprising:

a threaded inner surface that is engaged with the threaded outer surface of the distal end of the contact; and an aperture on a distal end of the activation nut, the aperture configured to enable the second conductor to be passed through the aperture of the activation nut and into the distal channel of the contact;

the electrical connector assembly configured such that:

in response to rotation of the activation nut in a first rotational direction, the contact translates relative to the housing in a first longitudinal direction which causes the tines to slide down the taper of the housing, thereby radially compressing the tines around the first conductor; and in response to rotation of the activation nut in a second rotational direction, the contact translates relative to the housing in a second longitudinal direction which causes the tines to slide up the taper of the housing, thereby radially expanding the tines away from the first conductor.

2. The electrical connector assembly of claim 1, wherein the anti-rotation feature comprises a pin.

3. The electrical connector assembly of claim 1, wherein the activation nut aperture is further configured to receive a tool, wherein the activation nut is configured to be rotated by the tool.

4. The electrical connector assembly of claim 1, wherein the electrical connector assembly comprises a first configuration and a second configuration, the tines of the contact being substantially non-deformed in the first configuration and the tines being compressed radially inward by the tapered portion of the housing lumen in the second configuration.

5. The electrical connector assembly of claim 1, wherein:
the housing further comprises an elongate slot that receives the anti-rotation feature; and
the anti-rotation feature translates in the elongate slot as the contact translates relative to the housing.

6. The electrical connector assembly of claim 1, wherein the electrical connector is further configured such that the radial compression of the tines against the first conductor pushes a portion of the first conductor out of the contact.

7. The electrical connector assembly of claim 1, wherein at least one of the tines comprises a groove, the at least one of the tines being designed to bend at the groove during engagement with the tapered portion of the housing.

8. The electrical connector assembly of claim 1, wherein at least one of the tines comprises teeth for gripping the first conductor.

9. The electrical connector assembly of claim 1, wherein the proximal end of the housing comprises a threaded outer surface.

10. The electrical connector assembly of claim 9, wherein the threaded outer surface of the contact is threaded in a first direction and the threaded outer surface of the housing is threaded in a second direction, opposite the first direction.

11. An electrical connector assembly for connecting a first conductor and a second conductor, the electrical connector assembly comprising:
a contact configured to receive the first conductor and the second conductor, the contact comprising a plurality of tines bounding a passage;
a housing that receives a portion of the contact and that is configured to connect with an external structure, the housing comprising a conduit with a taper; and
an activation unit engaged with the contact, the activation unit configured to rotate relative to the contact, the connector assembly configured such that rotation of the activation unit relative to the contact transitions the contact between a first configuration and a second configuration;
wherein, in the first configuration, the contact is positioned in a first axial position relative to the housing and the tines are in a first radial position such that the first conductor can be inserted into the passage; and
wherein, in the second configuration, the contact is positioned in a second axial position relative to the housing and the tines are in a second radial position such that the tines grip the first conductor in the passage, thereby securing the first conductor from pull-out.

12. The electrical connector assembly of claim 11, wherein, during the transition between the first and second configurations, the contact slides within the housing.

13. The electrical connector assembly of claim 11, further comprising an anti-rotation pin configured to inhibit relative rotation of the contact and the housing, the connector assembly further configured such that the anti-rotation pin slides in a longitudinal slot of the housing during the transition between the first configuration and the second configuration.

14. The electrical connector assembly of claim 11, wherein the connector assembly has a longitudinal length in the first configuration that is substantially equal to the longitudinal length in the second configuration.

15. A method of using a crimpless electrical connector assembly to establish an electrical connection between a first conductor and a second conductor, the electrical connector assembly comprising a contact, an outer housing configured to connect with an external structure, and an activation unit, the method comprising:
inserting the first conductor into a proximal end of the contact, a portion of the contact comprising tines that are configured to be elastically deformed around the first conductor, the contact being electrically conductive;
engaging a tool with the activation unit;
moving, using the tool, the activation unit in a first direction relative to the contact;
sliding the tines of the contact along a tapered surface of the outer housing;
radially compressing the tines against the first conductor, thereby gripping the first conductor in the contact; and
inserting the second conductor through an aperture in the activation unit and into a distal end of the contact.

16. The method of claim 15, wherein engaging the tool with the activation unit comprises inserting the tool into the aperture of the activation unit.

17. The method of claim 15, wherein moving the activation unit relative to the contact comprises rotating the activation unit relative to the contact around a longitudinal axis.

18. The method of claim 15, wherein the method further comprises engaging threads on an outer surface of the housing with threads of an external insulating structure.

19. The method of claim 15, wherein sliding the tines of the contact along the tapered surface of an outer housing comprises disengaging a portion of threads of the contact from a portion of threads of the activation unit.

20. The method of claim 15, further comprising maintaining, with an anti-rotation feature, the contact and the housing in a rotational position relative to each other.

21. The method of claim 20, further comprising sliding the anti-rotation feature along a slot in the outer housing.

22. A method comprising:
establishing, with method of claim 15, the electrical connection between the first conductor and the second conductor; and
disconnecting the electrical connection between the first conductor and the second conductor, wherein disconnecting the electrical connection comprises:
moving, using the tool, the activation unit in a second direction relative to the contact, the second direction generally opposite the first direction;
radially expanding the tines away from the first conductor, thereby releasing the first conductor from the grip of the contact; and
removing the first conductor from the contact.

23. The method of claim 22, wherein moving the activation unit relative to the contact comprises rotating the activation unit relative to the contact around a longitudinal axis.

24. The method of claim 22, further comprising sliding the contact toward the aperture in the activation unit.

* * * * *